US005115568A

United States Patent [19]

Aida

[11] Patent Number: 5,115,568

[45] Date of Patent: May 26, 1992

[54] CUTTER FOR CUTTING THE FOLDED EDGE OF FOLDED PAPER SHEETS OR THE LIKE

[75] Inventor: Masaaki Aida, Sumida, Japan

[73] Assignee: Midori Co., Ltd., Tokyo, Japan

[21] Appl. No.: 743,810

[22] Filed: Aug. 12, 1991

[51] Int. Cl.[5] ..... B26B 29/00

[52] U.S. Cl. ..... 30/294; 30/289; 30/DIG. 3

[58] Field of Search ..... 30/294, 278, 280, 289, 30/DIG. 3, 337, 335; 83/912

[56] References Cited

U.S. PATENT DOCUMENTS

| | | | |
|---|---|---|---|
| 844,770 | 2/1907 | Bauer | 30/294 |
| 1,821,716 | 9/1931 | Kusiv | 30/289 |
| 2,187,634 | 1/1940 | Söderlind | 30/289 |
| 2,204,763 | 6/1940 | Maximilian | 30/289 |
| 2,688,187 | 9/1954 | Pauli | 30/294 |
| 4,270,416 | 6/1981 | Thompson | 30/339 |
| 4,741,105 | 5/1988 | Wong | 30/DIG. 3 |
| 4,873,767 | 10/1989 | Lok | 30/278 |

FOREIGN PATENT DOCUMENTS

WO9004525 5/1990 PCT Int'l Appl. ..... 83/912

*Primary Examiner*—Frank T. Yost
*Assistant Examiner*—Hwei-Siu Payer
*Attorney, Agent, or Firm*—Wenderoth, Lind & Ponack

[57] ABSTRACT

A cutter for cutting the holded edge of folded paper sheets or the like is disclosed, which comprises a box-like casing, a channel-like groove provided in the casing along one edge thereof, the folded edge of folded paper sheets or the like being fed through the groove, a pair of leaf springs disposed such as to oppose each other in and along the groove and in a close proximity of or in forced contact with each other to form a paper sheet folded edge guide region substantially in a central portion of the groove in the length direciton thereof, a cutter blade holder carrying a cutter blade having a cutting end extending in the paper sheet folded edge guide region and removably mounted in the casing, and a cutter blade holder stopper mechanism for restraining and releasing the cutter blade holder with respect to the casing.

2 Claims, 7 Drawing Sheets

CUTTER FOR CUTTING THE FOLDED EDGE OF FOLDED PAPER SHEETS OR THE LIKE

BACKGROUND OF THE INVENTION

1. Field of the Invention

This invention relates to a cutter for cutting and opening the folded edge of envelopes, folded paper sheets, etc.

2. Prior Art Statement

A well-known apparatus for cutting and opening the envelope edge comprises a box-like casing having a groove-like path for feeding the envelope edge therealong and a circular cutter provided in the casing such as to extend in the groove-like path and rotationally driven by a motor or the like. The edge portion of an envelope is passed through the groove-like path to be cut at its position space apart by 2 to 3 mm from the envelope edge.

This prior art cutter, however, produces fine and elongate cutting dust as wide as 2 to 3 mm as a result of cutting envelope edges, and the disposal of this cutting dust is cumbersome. This problem is particularly serious when a large number of envelopes are opened successively.

Moreover, the cutter noted above and like cutters of various kinds in the prior art, irrespective of whether they are motor-driven or manually operable and also irrespective of the shape and kind of the cutter blade, is not provided with any means for correcting a frayed state, if any, of an envelope as in the case of an old envelope. Therefore, a frayed portion of envelope gets out of the cutting region of the cutter when cutting the edge of the envelope. In such a case, the envelope comes out with a remaining edge portion remaining without being cut away and disabling smooth opening of the envelope.

Further, with the above prior art cutter or the like, a cover and other members surrounding the cutter blade have to be removed every time the cutter blade is to be cleaned or replaced, and the removal operation is very cumbersome.

SUMMARY OF THE INVENTION

The present invention seeks to solve the above problems inheerent in the prior art, and it has an object of providing a cutter for cutting the folded edge of folded paper sheets, which can cut the folded edge of folded paper sheets smoothly at all times without producing any cutting dust and irrespective of the state of the paper sheets and also permits ready cleaning or the like of the cutter blade.

To attain this object of the invention, there is provided a cutter for cutting the folded edge of folded paper sheets or the like, which comprises a box-like casing, a channel-like groove provided in the casing along one edge thereof, the folded edge of folded paper sheets or the like being fed through the groove, a pair of leaf springs disposed such as to oppose each other in and along the groove and in a close proximity of or in forcec contact with each other to form a folded paper sheet edge guide section substantially in a central portion of the groove in the length direction thereof, a cutting blade holder carrying a cutter blade having a cutting end extending in the folded paper sheet edge guide region and removally mounted in the casing, and a cutter blade holder stopper mechanism for restraining and releasing the cutter blade holder with respect to the casing.

As a preferred form of the cutter for cutting the folded edge of paper sheets according to the invention, the cutter blade holder carrying the cutter blade has a recessed portion formed at a position corresponding to the stem of the cutting end of the cutter blade.

The cutter according to the invention has the following functions.

With the first-mentioned cutter, the folded edge portion of folded paper sheets or the like, fed through the channel-like groove, reaches an end guide region formed by a pair of leaf springs and is guided along the guide region while being urged elastically. Thus, the folded edge can be reliably cut even if the edge portion is in a frayed state. In addition, the cutter blade holder can be removed from the casing by releasing it from its restrainment by operating the cutter blade holder stopper mechanism, thus permitting ready cleaning or replacement of the cutter blade.

With the second-mentioned cutter, in which the cutter blade holder has a recessed portion formed at a position corresponding to the stem of the cutting end of the cutter blade, the edge of paper sheets encounters no touching object when it is cut. Thus, smoother cutting can be obtained. In addition, very fine particles that might be produced while cutting the edge can be collected in the recessed portion for subsequent disposal. The cutting end of the cutter blade thus encounters no interference with fine particles when cutting the edge of paper sheets, that is, it is possible to maintain the cutting end in an optimum cutting state at all times.

BRIEF DESCRIPTION OF THE DRAWINGS

FIG. 5(*b*) is a sectional view taken along line III—III in FIG. 4;

FIG. 6(*c*) is a perspective view showing an envelope after cutting operation;

DETAILED DESCRIPTION OF THE PREFERRED EMBODIMENT

Now, a preferred embodiment of the cutter according to the invention will be described with reference to FIGS. 1 to 5 of the accompanying drawings.

Referring to FIGS. 1 to 5, there is shown a cutter 1 for cutting the folded edge of folded paper sheets or the like. The cutter 1 comprises a rectangular box-like casing 2. One longitudinal edge surface 2*a* of the casing 2 is provided with a substantially central longitudinal channel-like groove 3, which has a depth of about 1 cm and serves as a path for feeding the folded edge of paper sheets P or the like.

Figure 2:
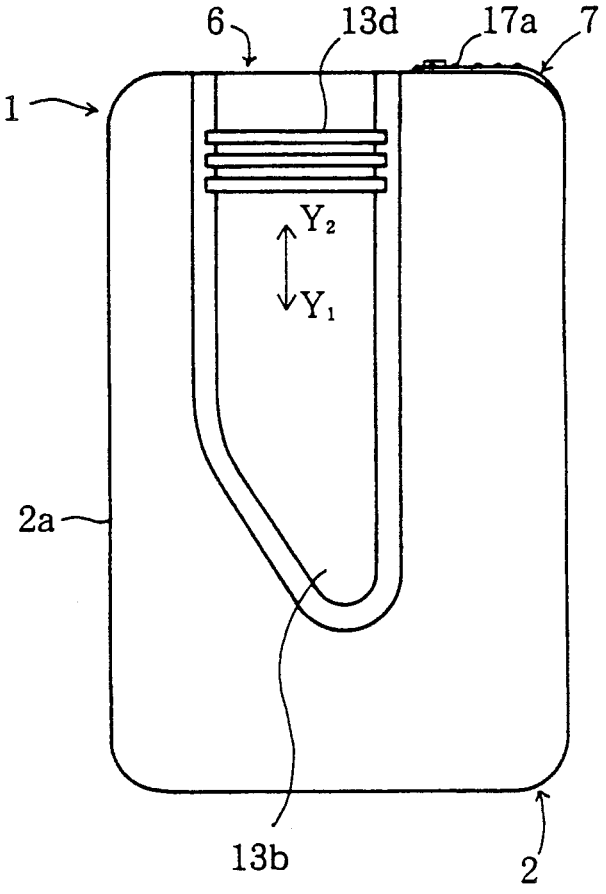
FIG. 2 is an elevational view showing the same.

The cutter 1 further comprises a pair of leaf springs 4*a* and 4*b* disposed in the groove 3 such that their urging surfaces oppose each other, a cutter blade holder 6 carrying a cutter blade 5 having a cutting end extending in the neighborhood of the the two leaf springs 4*a* and 4*b* in the groove 3 and removably mounted in the casing 2 for movement with respect to the casing 2 in directions shown by arrows Y1 and Y2 in FIG. 2, and a cutter blade holder stopper mechanism section 7 for restraining and releasing the cutter blade holder 6 with respect to the casing 2.

Figure 1:
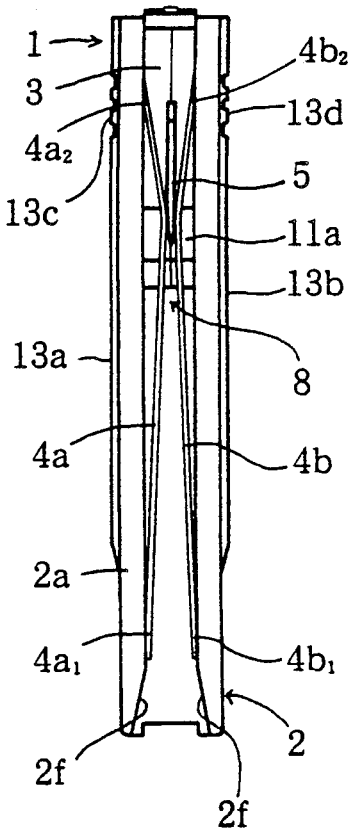
FIG. 1 is a side view showing showing an embodiment of the invention.

The pair leaf springs 4*a* and 4*b* are strip-like and, as shown in FIG. 1, extend from a position adjacent to lower end guide surfaces 2*f* of the groove 3 to the neighborhood of the upper end of the groove 3 such that their urging surfaces oppose each other. More specifically, the two leaf springs 4*a* and 4*b* have their lower end portions 4*a*1 and 4*b*1 secured to the opposed walls of the groove 3 near the lower end thereof and their upper end portions 4*a*2 and 4*b*2 in contact with the opposed walls of the groove 3 near the upper end thereof.

The leaf springs 4*a* and 4*b* have their substantially central portions in the close proximity of or in forced contact with each other substantially in a central portion of the groove 3 in the length direction thereof and form a folded paper sheet edge guide region 8 in this portion.

Figure 4:
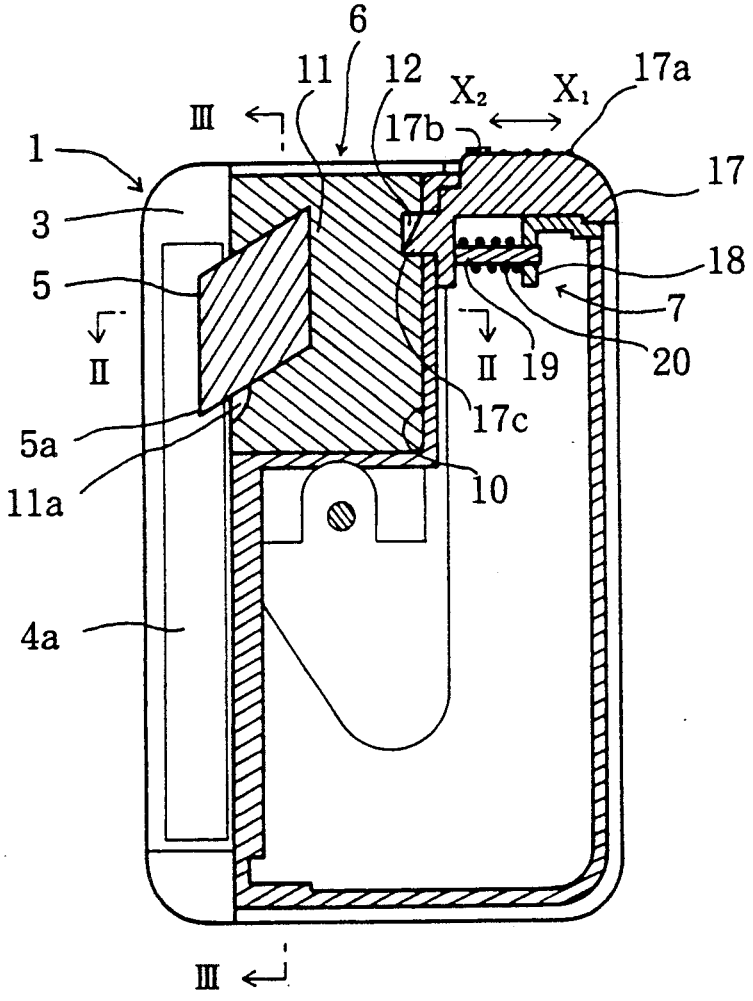
FIG. 4 is a sectional view taken along line I—I in FIG. 3.

The cutter blade holder 6, as shown in FIGS. 1, 2, 4 and 9, has a rectangular frame 10, which can be mounted in a cutter blade holder reception recess 9 provided in the casing 2. The frame 10 carries a cutter blade holding member 11, which extends substantially from a central portion toward one end of the frame 10. A cutter blade 5 which is like a flat plate-like member, is mounted in the cutter blade holding member 11 such that its cutting end 5*a* is directed down as shown in FIG. 4. The cutter blade holding member 11 has a recessed portion 11*a* formed at a position corresponding to the stem of the cutting end 5*a* of the cutter blade 5, as shown in FIGS. 1 and 4.

The frame 10 has its edge opposite the recessed portion 11*a* with an engagement recess 12 for engagement with the cutter blade holder stopper mechanism section 7.

The opposite sides of the frame 10 are provided with respective symmetrical and parallel side members 13*a* and 13*b* secured to them, as shown in FIGS. 1, 2, 8 and 9. The side members 13*a* and 13*b* have their outer surfaces formed with anti-slip gnarls 13*c* and 13*d*, and they each have a tapering lower end portion and an arcular lower end. The lower ends are adapted to engage with shoulders 2*c* and 2*d* of the casing 2 as shown in FIG. 5(*b*).

Figure 5A:
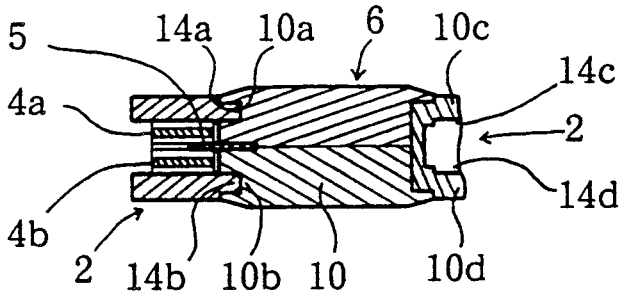
FIG. 5(*a*) is a sectional view taken along line II—II in FIG. 4.
Figure 5B:
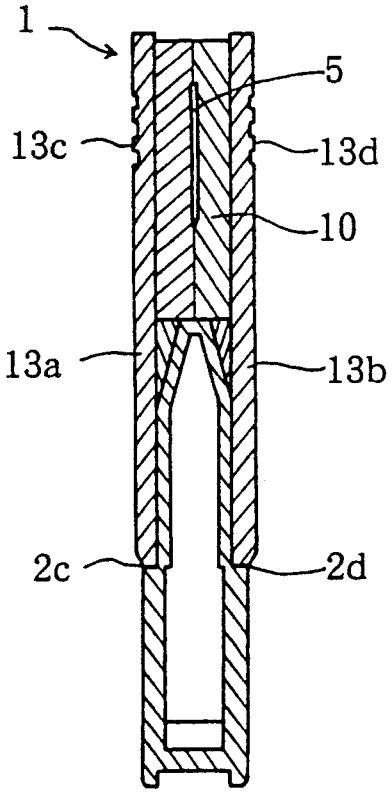
Figure 6A:
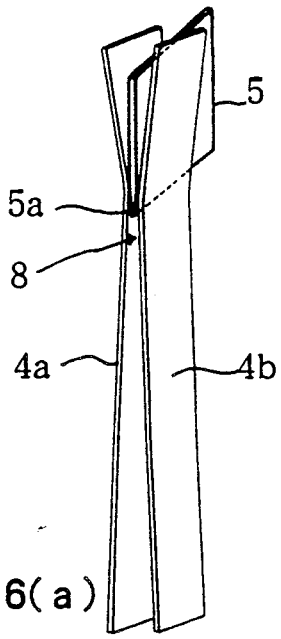
FIGS. 6(*a*) and 6(*b*) are views for explaining the operation of cutting an envalope with the cutter according to the invention.
Figure 6B:
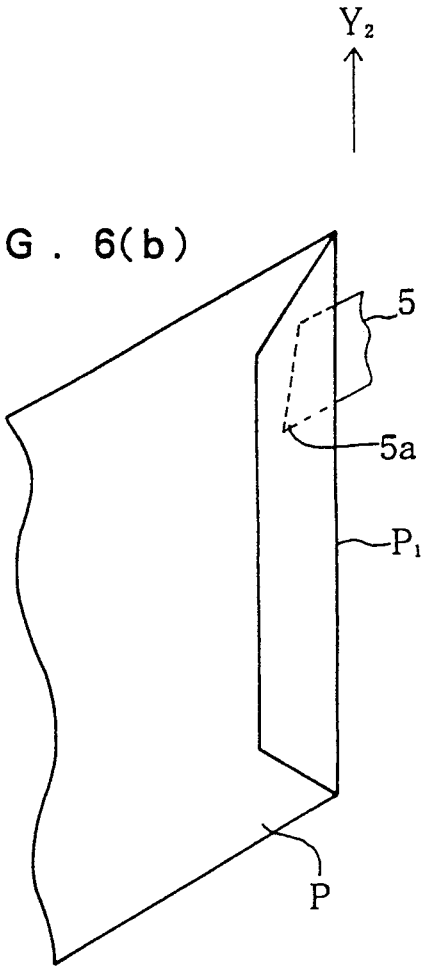
Figure 6C:
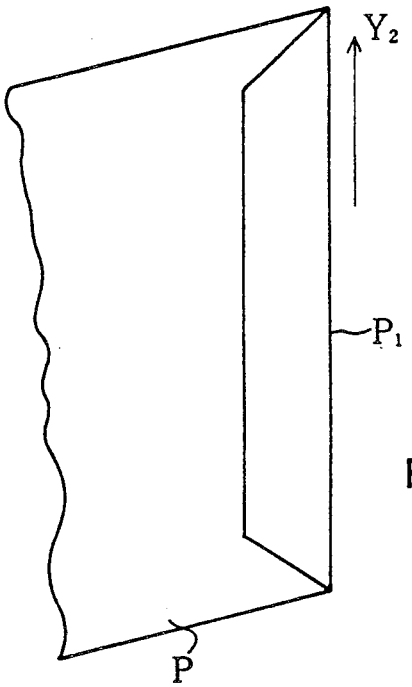
Figure 6C:
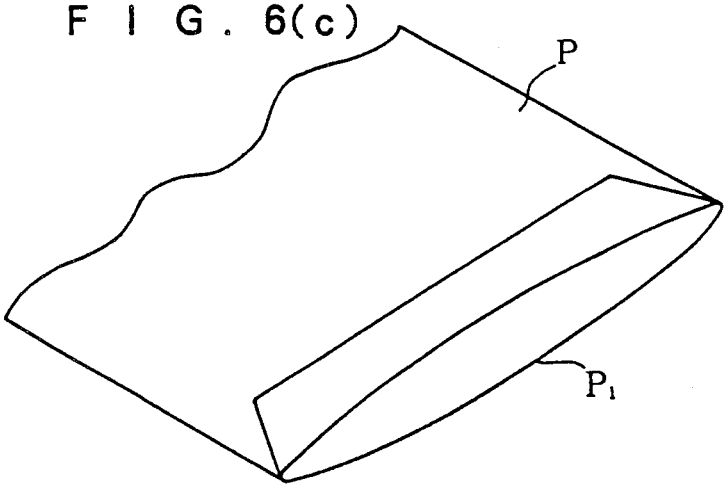

The frame 10, as shown in FIG. 5(*a*), has one edge provided with a pair of parallel engagement grooves 10*a* and 10*b* extending in the directions of arrows Y1 and Y2, and has the other edge provided with a pair of parallel ridges 10*c* and 10*d* extending in the directions of arrows Y1 and Y2.

The pair engagement grooves 10*a* and 10*b*, as shown in FIG. 5(*a*), engage with pair projections 14*a* and 14*b* of the casing 2, and with the frame 10 mounted in the casing they engage with the upper ends 4*a*2 and 4*b*2 of the leaf springs 4*a* and 4*b* to hold a constant space between the upper ends 4*a*2 and 4*b*2 of the two leaf springs 4*a* and 4*b*. The pair ridges 10*c* and 10*d*, as shown in FIG. 5(*a*), engage in notches 14*c* and 14*d* formed in the casing 2.

The cutter blade holder stopper mechanism sedtion 7, as shown in FIG. 4, includes an operating member 17 mounted in the casing 2 for movement in directions of arrows X1 and X2, a guide rod 19 loosely inserted in a hole of an L-shaped member 18 provided on the casing 2 and integral with the operating member 17, and a spring 20 fitted on the guide rod 19 and providing a biasing force to the operating member 17 in the direction of arrow X2. The operating member 17 has a stopper 17*c* engaged in the engagement rercess 12 of the frame 10.

Figure 3:
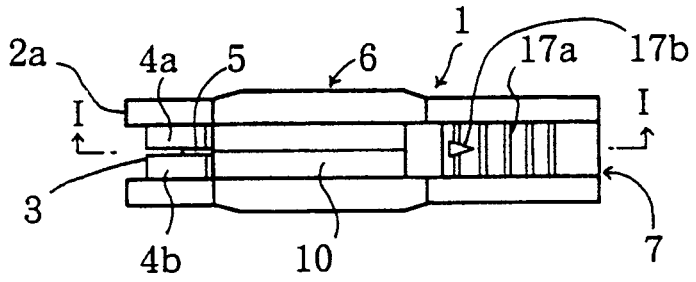
FIG. 3 is a plan view showing the same.

The operating member 17 is provided at its top with a plurality of, for instance five, small ridges 17*a* for an anti-slip purpose when the operating member 17 is operated. As shown in FIG. 3, it is further, provided at the top with a triangular mark 17*b* directing the direction ot arrow X1, i.e., direction of operation of the operating member 17.

The operation of the cutter 1 having the above construction will now be described in connection with an operation of cutting the folded edge of paper sheets, for instance an envelope P, and an operation of removing the cutter blade holder 6.

First, the operation of cutting an envelope P will be described with reference to FIGS. 1 to 6(*a*) to 6(*c*).

When the folded and sealed edge P1 of envelope P is fed upwards along the groove 3, as shown in FIG. 6(*a*), it proceeds between the two leaf springs 4*a* and 4*b* to reach the folded paper sheet edge guide region 8, and in this region 8 it is pinched and, in this state, guided to a position corresponding to the cutting end 5*a* of the cutter blade 5. With this guide function of the guide region 8, the edge P1 of the envelope P can be accurately brought to the position corresponding to the cutting edge 5*a* of the cutter blade 5 even if it is frayed.

The cutting end 5*a* of the cutter blade 5, as shown in FIG. 6(*b*), intrudes into the edge portion P1 of the envelope reaching the position corresponding to the cutting end 5*a* by cutting the folded edge. In this way, the folding edge P1 is cut apart without producing any cutting dust.

Since the cutter blade holding member 11 carrying the cutter blade 5 has the recessed portion 11*a*, which is formed at a position corresponding to the stem of the cutting end 5*a* of the cutter blade 5, there is no part or object touching the edge P1 when the edge P1 is cut apart. Thus, smoother cutting operation can be ensured. Further, with the provision of the recessed portion 11*a*, fine particles that may be produced with the cutting of the edge P1 can be collected in the recessed portion 11*a* for subsequent disposition. That is, no particles or the like will interfere with the operation of cutting with the cutting end 5*a*, and it is possible to maintain an optimum state of cutting with the cutting end 5*a* at all times.

FIG. 6(*c*) shows the edge P1 after cutting.

Now, the operation of removing the cutter blade holder 6 will be described with references to FIGS. 7 to 10.

Figure 7:
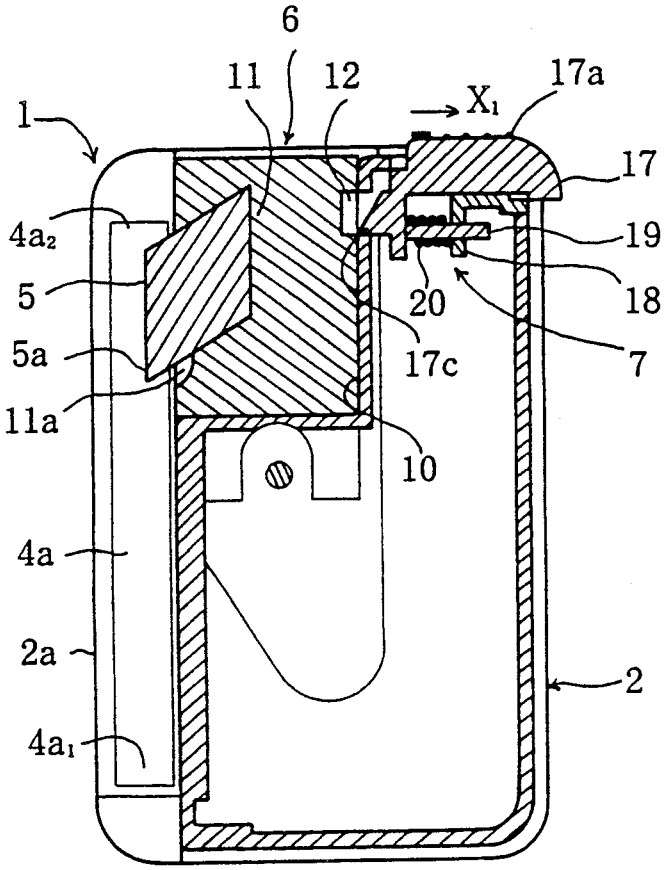
FIGS. 7 to 9 are views for explaining the operation of removing a cutter blade holder.

First, the operating member 17 is moved in the direction of arrow X1 with a finger of the operator, as shown in FIG. 7. At this time, the direction of movement of the operating member 17 can be readily confirmed by noting the mark 17*b* thereof.

Figure 8:
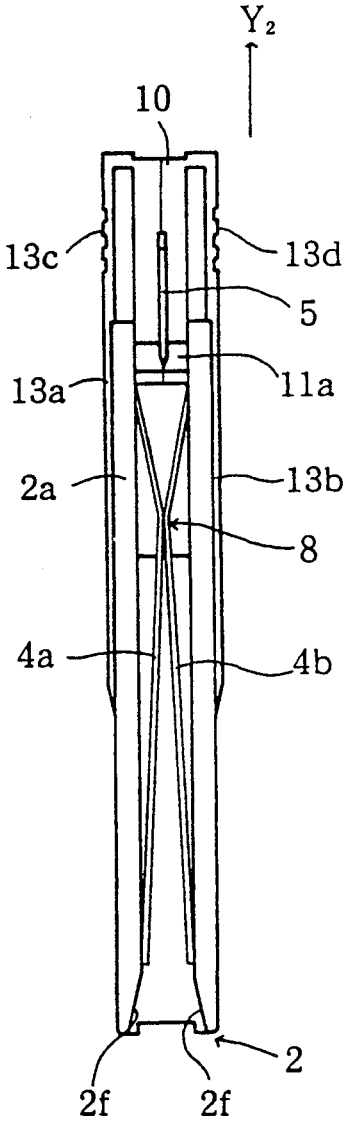
Figure 9:
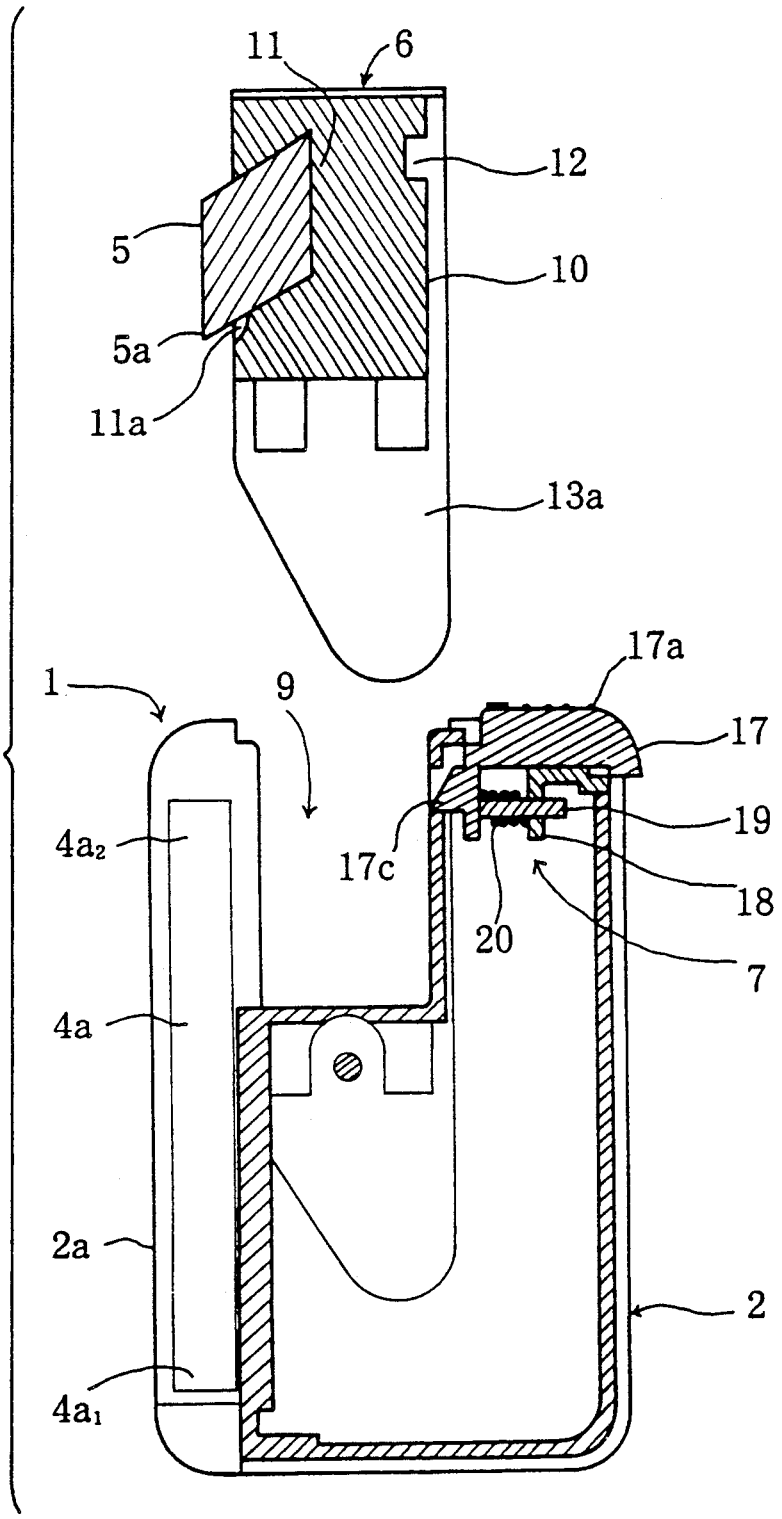
Figure 10:
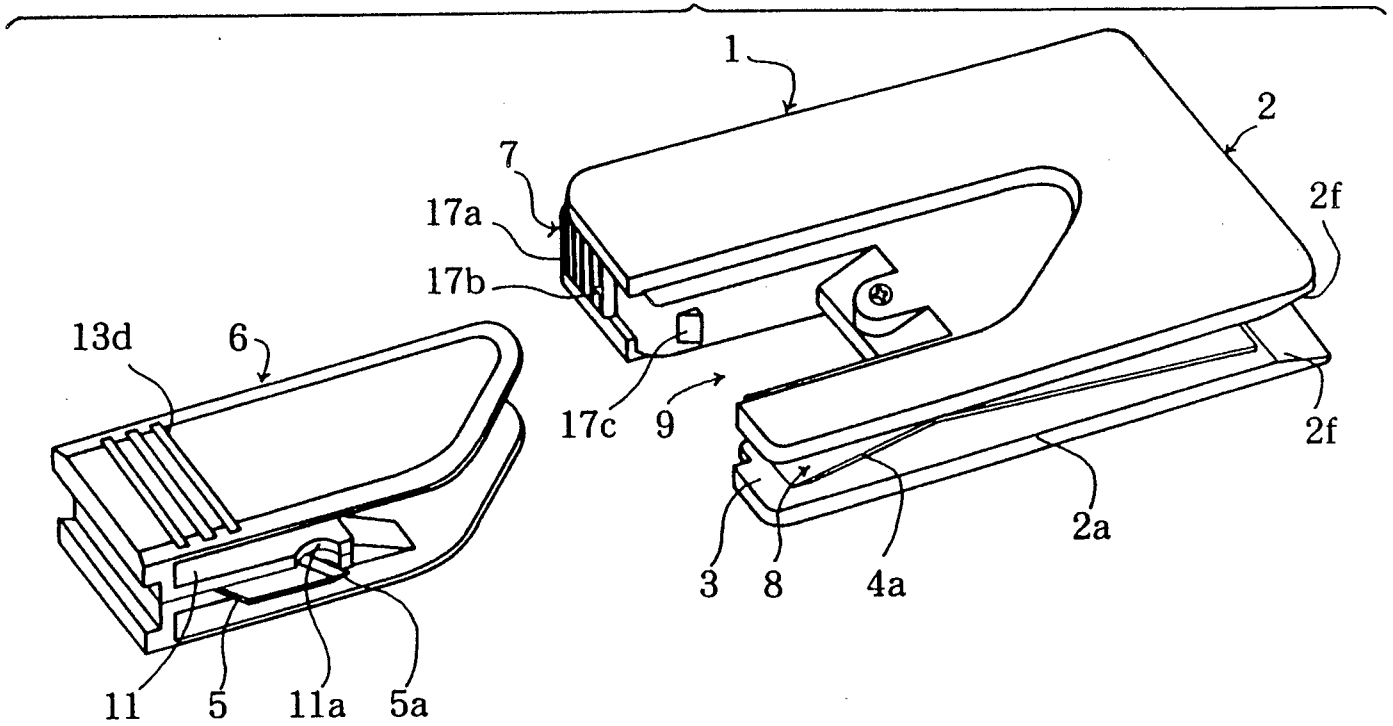
FIG. 10 is a perspective view showing the cutter with removed cutter blade holder.

By moving the operating member 17 in the direction of arrow X1, the stopper 17*c* is detached from the engagement recess 12 of the frame 10, as shown in FIG. 7. In this state, the cutter blade holder 6 is moved in the direction of arrow Y2, as shown in FIG. 8. Further, the frame 10 is completely removed from the recess 9, as shown in FIG. 9. The final state is also shown in FIG. 10.

In this state, the cutting end 5*a* of the cutter blade 5 is exposed, and thus the cleaning thereof is possible. Also, it is possible to replace the cutter blade holder 6 as a whole or remove the cutter blade 5 and replace the same with a new one.

As has been shown, according to the invention it is possible to cut and open the edge of an envelope P, either new or old, without producing any cutting dust and also readily clean or replace the cutter blade holder 6 or cutter blade 5 alone. In addition, since the cutting end 5*a* of the cutter blade 5 is confined in the groove 3 and not projecting from the casing 2, there is no possibility of injuring fingers or the like.

Further, since the cutter blade holder 6 is firmly secured to the casing 2 by the cutter blade holder stopper mechanism section 7, the cutter blade holder 6 will never occasionally get out of the casing 2. Excellent safety thus can be ensured in this respect as well. Further, since the side plates 13*a* and 13*b* can be seen in the shape as noted above, i.e., in a shape like an arrow in plan view, the direction of feed of the envelope P along the groove 3 can be readily confirmed.

The above embodiment of the invention is by no means limitative, and various changes and modifications can be made without departing from the scope of the invention.

For example, while the above embodiment concerned with the case of cutting and opening envelopes, the invention is similarlly applicable as well to the case of cutting the folded edge of paper pieces or resin sheets.

As has been described in the foregoing, according to the invention it is possible to provide a cutter for cutting the folded edge of paper sheets, which can reliably cut the folded edge of folded paper sheets or the like without producing any cutting dust and irrespective of whether the paper sheets are frayed, and also in which the cutter blade holder can be readily removed from the casing to permit ready cleaning or replacement of the cutter blade.

What is claimed is:

1. A cutter for cutting the folded edge of folded paper sheets comprising:

a casing;

a groove provided in said casing along one edge thereof, the folded edge of folded paper sheets being fed through said groove;

a pair of leaf springs disposed such as to oppose each other in and along said gooove and in a close proximity of or in forced contact with each other to form a folded paper sheet edge guide region substantially in a central portion of said groove in a length direction thereof;

a cutter blade holder carrying a cutter blade having a cutting end extending in said folded paper sheet edge guide region and removably mounted in said casing; and a cutter blade holder stopper mechanism for restraining and releasing said cutter blade holder with respect to said casing.

2. The cutter for cutting the folded edge of folded paper sheets according to claim 1, wherein said cutter blade holder carrying said cutter blade has a recessed portion formed at a position corresponding to a stem of said cutting end of said cutter blade.

* * * * *